US007111360B1

(12) United States Patent
Hsu

(10) Patent No.: US 7,111,360 B1
(45) Date of Patent: Sep. 26, 2006

(54) DOOR CATCH

(76) Inventor: Ming-Piao Hsu, No. 17, Lane 50, Jen Te San St., Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 11/115,147

(22) Filed: Apr. 27, 2005

(51) Int. Cl.
*E05C 19/00* (2006.01)

(52) U.S. Cl. ..... 16/85; 16/82; 16/83; 292/DIG. 15; 292/9; 292/252

(58) Field of Classification Search ..... 16/82, 16/85, 83; 292/DIG. 15, DIG. 61, 9, 23, 292/252, 163, 295, 302; 220/229
See application file for complete search history.

(56) References Cited

U.S. PATENT DOCUMENTS 2,465,088 A * 3/1949 Gussack ..... 217/60 C
4,050,723 A * 9/1977 Papadatos ..... 292/164
4,823,432 A * 4/1989 Jan ..... 16/86 A
5,018,241 A * 5/1991 Baines ..... 16/82
5,593,194 A * 1/1997 Liau ..... 292/340
6,151,754 A * 11/2000 Chen ..... 16/85
6,584,642 B1 * 7/2003 Hodson ..... 16/85
6,629,335 B1 * 10/2003 Derman ..... 16/85
6,651,295 B1 * 11/2003 Hodson ..... 16/85
2005/0217072 A1 * 10/2005 Lin ..... 16/85

* cited by examiner

*Primary Examiner*—Chuck Y. Mah
*Assistant Examiner*—Michael J. Kyle
(74) *Attorney, Agent, or Firm*—Leong C. Lei

(57) ABSTRACT

A door catch includes a back plate having two laterally symmetric sleeves formed on a front face thereof. A slot is provided on the back plate behind each of the sleeves at a predetermined position to communicate with an inner space of the sleeve, and an insert plate is inserted from a back face of the back plate into the sleeve via the slot to confine a steel ball and a spring in the sleeve, such that the springs not only normally push the steel balls forward to partially project from front open ends of the sleeves for tightly clamping a corresponding stop post between the balls, but also tightly push against the insert plates to hold the latter in place. The insert plates are held down in place in the sleeves by a wall when the back plate is mounted on the wall with fastening elements.

1 Claim, 1 Drawing Sheet

DOOR CATCH

BACKGROUND OF THE INVENTION (a) Technical Field of the Invention

The present invention relates to a door catch, and more particularly to a door catch that includes two insert plates to enable easier assembling and mounting and reduced manufacturing cost thereof.

(b) Description of the Prior Art

In a conventional door catch as shown in FIGS. 1 and 2, there is included a back plate 1 having two laterally symmetric sleeves 2 formed on a front face thereof. A steel ball 3 and a spring 4 are mounted in each of the two sleeves 2, and a screw 5 is screwed to a rear end of the sleeve 2 to confine the ball 3 and the spring 4 in the sleeve 2, so that the ball 3 is normally pushed by the spring 4 to partially project from a front open end of the sleeve 2. To use the door catch, first fixedly mount the back plate 1 on a wall 10 with fastening elements to correspond to a stop post 6 fixedly mounted on a back of a movable door leaf 20, so that the stop post 6 is clamped by and between the two steel balls 3 partially projected from the front ends of the two sleeves 2 when the door leaf 20 is opened. The use of the screw 5 to confine the steel ball 3 and the spring 4 in the sleeve 2 is labor and time consuming, and it is possible the screw 5 become loosened to finally separate from the sleeve 2. Moreover, the conventional door catch with the above structure must be made of a metal material, and therefore requires a relatively high manufacturing cost.

SUMMARY OF THE INVENTION

The primary purpose of the present invention is to provide an improved door catch to eliminate the drawbacks existing in the conventional door catches.

To achieve the above and other objects, the door catch according to the present invention includes a back plate having two laterally symmetric sleeves formed on a front face thereof. A slot is provided on the back plate behind each of the sleeves at a predetermined position to communicate with an inner space of the sleeve, and an insert plate is inserted from a back face of the back plate into the sleeve via the slot to confine a steel ball and a spring in the sleeve, such that the springs not only normally push the steel balls forward to partially project from front open ends of the sleeves for tightly clamping a corresponding stop post between the balls, but also tightly push against the insert plates to hold the latter in place. The insert plates are held down in place in the sleeves by a wall when the back plate is mounted on the wall with fastening elements. Therefore, the door catch of the present invention is easy to assemble and mount without the risk of loosened and/or separated insert plates.

Moreover, the whole door catch of the present invention can be made of a non-metal material to reduce the manufacturing cost thereof.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
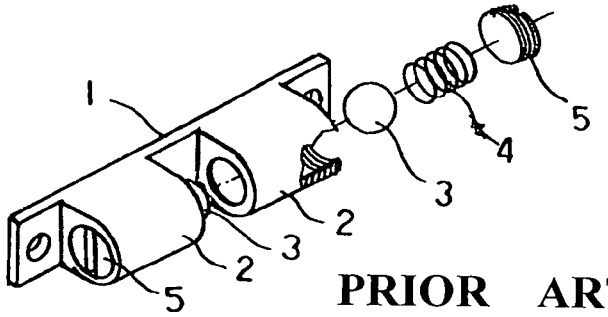
PRIOR ART FIG. 1
FIG. 1 is an exploded perspective view of a conventional door catch.
Figure 2:
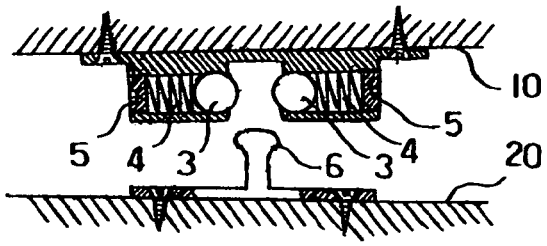
PRIOR ART FIG. 2
FIG. 2 is an assembled top sectional view of the door catch of FIG. 1.
Figure 3:
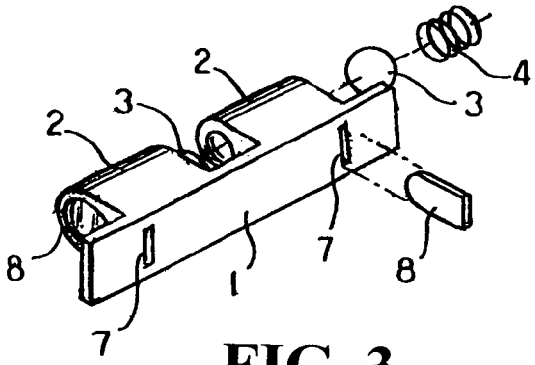
FIG. 3 is an exploded perspective view of a door catch according to the present invention.
Figure 4:
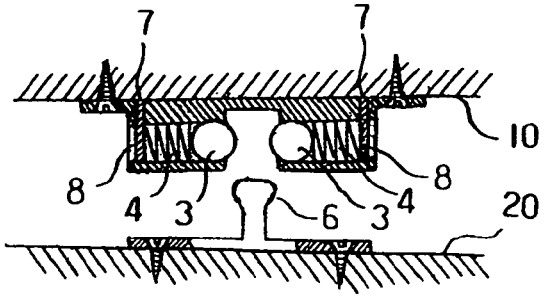
FIG. 4 is an assembled top sectional view of the door catch of FIG. 3.

Please refer to FIGS. 3 and 4, which are exploded perspective view and assembled top sectional view, respectively, of a door catch according to the present invention. As shown, the door catch of the present invention includes a back plate 1 having two laterally symmetric sleeves 2 formed on a front face thereof. The door catch of the present invention is characterized in that a slot 7 is provided on the back plate 1 behind each of the sleeves 2 at a predetermined position to communicate with an inner space of the sleeve 2, so that an insert plate 8 may be inserted from a rear face of the back plate 1 into the sleeve 2 via the slot 7 to close a rear end of the sleeve 2 and thereby confines a steel ball 3 and a spring 4 in the sleeve 2, permitting the spring 4 to, on the one hand, normally push the steel ball 3 forward to partially project from a front open end of the sleeve 2, and on the other hand, tightly push against the insert plate 8 to prevent the latter from moving.

To use the door catch of the present invention, simply fixedly mount the back plate 1 and a corresponding stop post 6 on a wall 10 and behind a movable door leaf 20, respectively, at two corresponding positions. When the door leaf 20 is opened, the stop post 6 is tightly clamped by and between the two steel balls 3 that are elastically pushed by the springs 4 to partially project from the front ends of the two sleeves 2.

A major advantage of the door catch of the present invention is that the two insert plates 8 are simultaneously held down in place in the sleeves 2 by the wall 10 when back plate 1 is fixedly mounted on the wall 10 with fastening elements. Therefore, the door catch of the present invention is easy to assemble and mount without the risk of loosened and/or separated insert plates 8. Moreover, the whole door catch of the present invention with the insert plates may be made of a material other than metal, such as a plastic material, to reduce the manufacturing cost thereof.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A door catch comprising:

a back plate having a front side provided with a first lateral sleeve and a second lateral sleeve, said first lateral sleeve having a first passage with a first inner opening and a first outer opening, said second lateral sleeve having a second passage with a second inner opening and a second outer opening, said back plate having a first slot and a second slot respectively located behind said first sleeve and said second sleeve, a first steel ball fitted in said first passage of said first sleeve from said first outer opening;

a first spring fitted in said first passage of said first sleeve and pushing said first ball partially project out said first inner opening of said first sleeve;

a second steel ball fitted in said second passage of said second sleeve from said second outer opening;

a second spring fitted in said second passage of said second sleeve and pushing said second ball partially project out said second inner opening of said second sleeve;

a first insert plate inserted into said first slot; and a second insert plate inserted into said second slot;

whereby said insert plates are pushed by said springs thereby preventing said insert plates from getting out of said sleeves and therefore preventing said steel balls and springs from falling out of said sleeves.

* * * * *